US006219978B1

(12) United States Patent
Wood

(10) Patent No.: US 6,219,978 B1
(45) Date of Patent: Apr. 24, 2001

(54) DEVICE FOR COVERING WINDOWS AND DOORS DURING SEVERE STORMS

(76) Inventor: Herman C. Wood, 27 Mulberry Glen Pl., The Woodlands, TX (US) 77382

( * ) Notice: Subject to any disclaimer, the term of this patent is extended or adjusted under 35 U.S.C. 154(b) by 0 days.

(21) Appl. No.: 09/568,487

(22) Filed: May 10, 2000

(51) Int. Cl.[7] ..... G04B 9/00

(52) U.S. Cl. ..... 52/202; 49/57; 49/463; 292/149

(58) Field of Search ..... 52/202, 106, 107, 52/507, 203; 49/50, 57, 61, 62, 463, 465; 292/137, 165, 149

(56) References Cited

U.S. PATENT DOCUMENTS

| | | | | |
|---|---|---|---|---|
| 389,704 | * | 9/1888 | Holland | 292/149 |
| 524,146 | * | 8/1894 | Hotties | 292/149 X |
| 2,431,178 | * | 11/1947 | Keane | 292/149 |
| 4,279,288 | | 7/1981 | Lanier . | |
| 4,372,082 | | 2/1983 | Pagel . | |
| 4,726,149 | | 2/1988 | Tryba . | |
| 5,335,452 | | 8/1994 | Taylor . | |
| 5,433,046 | | 7/1995 | MacQuarrie et al. . | |
| 5,507,118 | | 4/1996 | Brown . | |
| 5,623,791 | * | 4/1997 | Schwartz | 52/202 X |
| 5,722,206 | | 3/1998 | McDonald . | |
| 5,737,874 | * | 4/1998 | Sipos et al. | 52/202 X |
| 5,740,639 | * | 4/1998 | Covington et al. | 52/202 |
| 5,787,642 | * | 8/1998 | Coyle et al. | 52/202 X |
| 5,852,903 | * | 12/1998 | Astrizky | 52/202 |

FOREIGN PATENT DOCUMENTS

| | | | | |
|---|---|---|---|---|
| 2608665 | * | 6/1988 | (FR) | 49/67 |

* cited by examiner

*Primary Examiner*—Richard Chilcot
(74) *Attorney, Agent, or Firm*—Mary J. Gaskin

(57) ABSTRACT

A device is provided for protecting a window or door during severe storms. A panel, cut to fit in a window frame, is held in place by the action of the slide-arm-and-bolt assemblies described herein. A rubber gasket can be used along one side of the panel in place of some of the slide-arm-and-bolt assemblies. Different embodiments of the assembly are described for mounting along the sides or at the corners of the panel. A "clip-on" assembly is also described. Wind resistance is enhanced by tightening the assemblies until the panel bows outward. Optional security features are disclosed to prevent unauthorized removal of the panel.

21 Claims, 12 Drawing Sheets

DEVICE FOR COVERING WINDOWS AND DOORS DURING SEVERE STORMS

BACKGROUND OF THE INVENTION

The present invention relates to a device for protecting windows and doors from breakage and damage during severe storms, including hurricanes.

Presently, home and business owners who seek to minimize the damage caused by severe storms have few options for protecting windows and doors. Two of these options are very expensive and require time-consuming installation. One such option requires the removal of the pre-existing window and frame and replacement with a storm window having a frame with a slot for the insertion of a properly-sized piece of plywood. Another such option requires the installation of a storm shutter for each window, either a hinged shutter or a metal shield which is unrolled to cover the window. Many of the other devices for protecting windows require making holes in the window frame for insertion of braces or anchors. Some are cumbersome or difficult to install.

The least expensive option is buying and cutting pieces of plywood and nailing a piece of plywood over each window. However, after the storm has passed, the removal of the plywood leaves nail holes behind. Finally, some people simply apply tape to windows so that glass shards are not blown everywhere if the windows break during a storm. Needless to say, tape offers little or no protection from the storm itself.

A need presently exists for an inexpensive device which can be installed on short notice, without pre-installation, nailing, or screwing.

SUMMARY OF THE INVENTION

The present invention overcomes the disadvantages of existing options for protecting windows and doors during violent storms. The window covering devices herein disclosed can be easily installed, on short notice. They can be used over and over again, leaving no nail or screw holes in window frames.

The slide-arm-and-bolt assemblies can be sold in hardware stores. The plywood or other material is sold separately. (Plywood can be used from previous storm alerts). The panels that will cover the windows do not need to be cut precisely to size; they need only fit within one-half inch of the sill, head and sides of the window frame. Several alternative embodiments of the slide-arm-and-bolt assemblies are disclosed: one can be fastened to the wood; another can be slipped over the edge of the panel, requiring no drilling or fastening. Each device is installed with a wrench or pliers. Security features are also provided for the present invention.

A primary object of the present invention is to provide a window covering device which may be easily installed and removed.

Yet another object of the present invention is to provide a window covering device which can be assembled and installed by ordinary homeowners.

Still another object of the present invention is to provide a window covering device which can be installed in metal or brick frames, where nailing or screwing is not possible.

A further object of the present invention is to provide a window covering device which can be used on non-standard sized and shaped windows, as well as doors.

Another object of the present invention is to provide a window covering device which provides security from looting after a storm.

One more object of the present invention is to provide a window covering device which leaves no nail holes or screw holes in a window frame.

Yet another object of the present invention is to provide a window covering device which has increased holding power as the wind forces against it rise.

A still further object of the present invention is to provide an effective window covering device at a substantially lower cost than storm windows or shutters.

Several embodiments of the invention are described with reference to the following drawings.

DESCRIPTION OF THE PREFERRED EMBODIMENT

Figure 1:
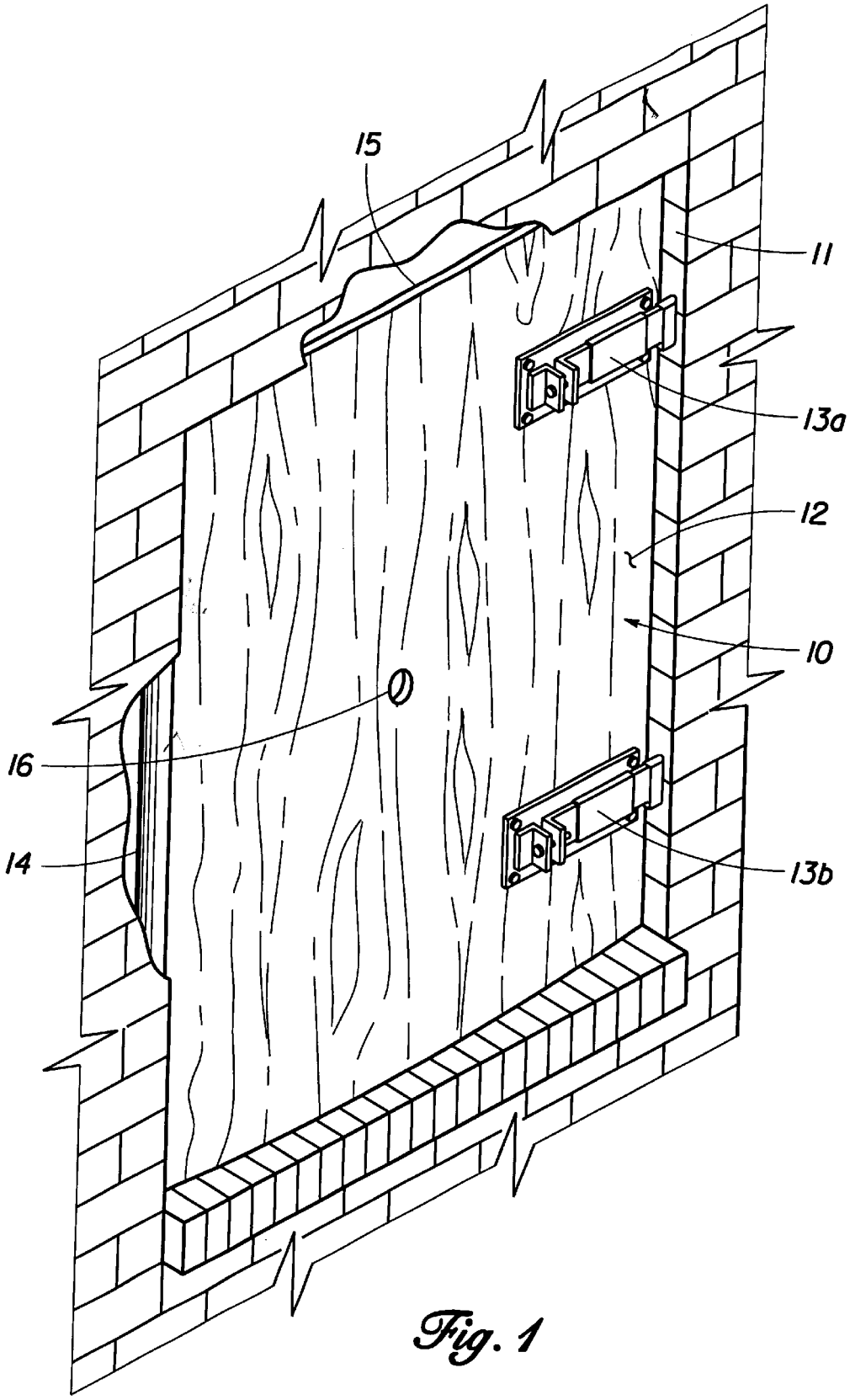
FIG. 1 is a perspective view of the window covering device installed in a window frame, with a pair of slide-arm-and-bolt assemblies, according to the present invention.

In FIG. 1, a window covering device 10 has been installed inside a window frame 11 on the exterior-facing side of a window (not shown). The panel 12 has been precut (with up to one-half inch allowance on all sides) to fit inside the window frame 11, without forcing. The panel 12 can be formed from wood or another material that is rigid with some give, such as plexiglass, aluminum, or expanded metal grating. Leftover plywood which had been nailed over windows in previous storms can be used. A pair of slide-arm-and-bolt assemblies 13*a*, 13*b* attached to the panel 12 hold it firmly in place within the window frame 11. The cutaway portion on the left shows the position of the gasket 14. The cutaway portion on the top shows the slight outward bowing 15 of the window covering device 10. Optionally, a small round hole 16 (approximately one-half inch in diameter) can be cut through the wood panel 12 to act as a finger grab for ensuring the bowing 15 occurs in the correct direction.

Figure 2:
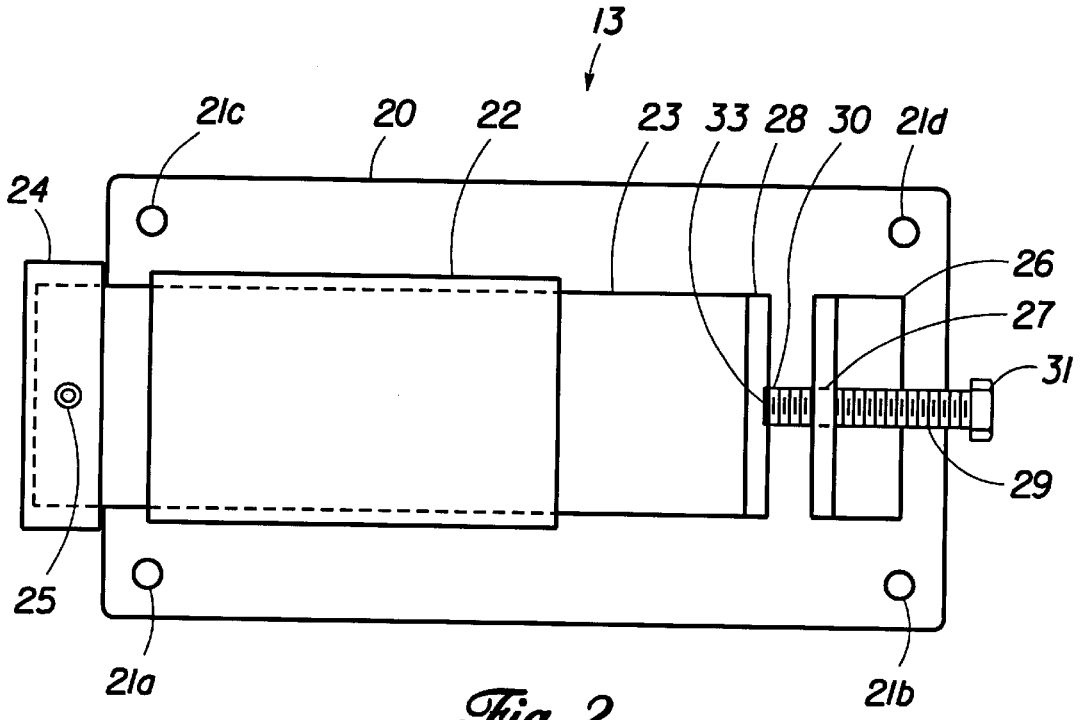
FIG. 2 is a top view of a single slide-arm-and-bolt assembly.

As shown in FIG. 2, the slide-arm-and-bolt assembly 13 comprises a metal base plate 20 with fastener holes 21*a*, 21*b*, 21*c*, 21*d*; a metal slide arm guide 22 welded to the base plate 20; an ell-shaped metal slide arm 23 inserted into the slide arm guide 22; a rubber stopper 24 attached to the end of the slide arm 23 with a rivet 25; an angle bolt bracket 26 with a threaded bolt hole 27 welded to the base plate 20 in a spaced-apart relationship to the upturned portion 28 of the slide arm 23; and a bolt 29 inserted through the bolt hole 27 with its threaded end 30 resting in a recess 33 in the upturned portion 28 of the slide arm 23. The bolt 29 is advanced by turning the bolt head 31 with a wrench or pliers.

Figure 3:
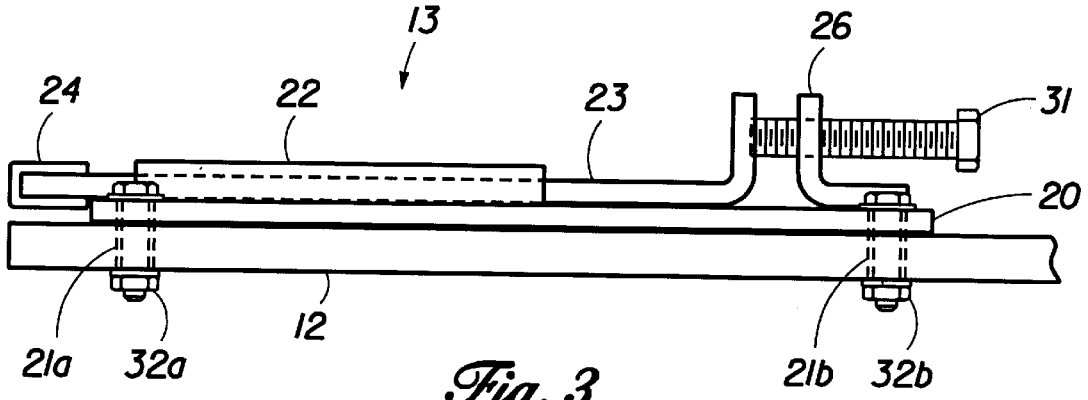
FIG. 3 is a side view of a single slide-arm-and-bolt assembly installed on a wood panel.

As shown in FIG. 3, the slide-arm-and-bolt assembly 13 has been fastened to a wood panel 12 with fasteners 32*a*, 32*b*, which have been inserted through fastener holes 21*a*, 21*b*. The fasteners 32*a*, 32*b* are typically bolts, but can be rivets or pins. Typically, two slide-arm-and-bolt assemblies 13*a*, 13*b* are attached to one side of a wood panel 12 in a parallel relationship, as shown in FIG. 1. Prior to installation, the end of the rubber stopper 24 of each slide-arm-and-bolt assembly 13*a*, 13*b* is arranged to be even with the edge of the wood panel 12.

Figure 4:
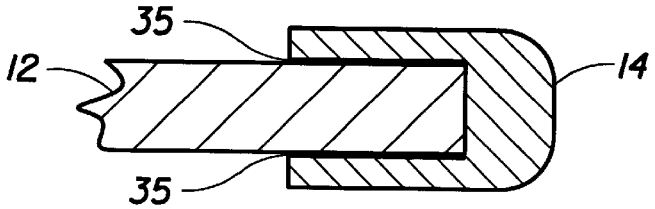
FIG. 4 is a horizontal section view of the gasket positioned on a side of a wood panel.

As shown in FIG. 4, a length of rubber edge gasket 14 is affixed to the edge of the wood panel 12 opposite that upon which the slide-arm-and-bolt assemblies 13*a*, 13*b* are fastened. The rubber edge gasket 14 can be made from rubber or any rubberlike material, such as cork or foam. Typically, the gasket 14 is slid over the edge of the wood panel 12 and adhesive 35 is used to bond the gasket 14 to the wood panel 12.

In order to complete installation of the wood covering device 10 in a window frame 11, as shown in FIG. 1, the edge of the wood panel 12 having the gasket 14 is positioned on the left side of the window frame 11. The side of the wood panel 12 having the slide-arm-and-bolt assemblies 13*a*, 13*b* is then pushed into place along the right side of the window frame 12. The bolt head 31 of each slide-arm-and-bolt assembly 13*a*, 13*b* is turned so that the threaded end 30 of each bolt 29 causes the slide arm 23 of each slide-arm-and-bolt assembly 13*a*, 13*b* to advance, pushing the rubber stopper 24 firmly against the window frame 11. Further advancing of the slide arm 23 results in the bowing 15 of the window covering device 10. Optimally, the bowing 15 is in an outward direction, resulting in increased holding power against strong winds. Removal of the panel 12 after the storm is quick and easy: the bolt head 31 of each slide-arm-and-bolt assembly 13*a*, 13*b* is turned in the opposite direction so that the threaded end 30 of each bolt 29 retracts from the slide arm 23; the rubber stopper 24 will no longer press against the window frame 11, and the panel 12 can be pulled out.

Figure 5:
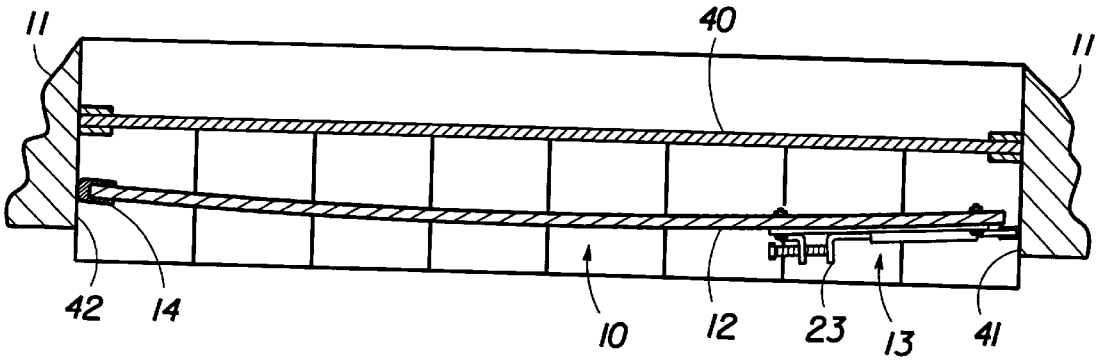
FIG. 5 is a horizontal section view of the window covering device, which someone outside a dwelling has installed in the window frame on the exterior-facing side of the window.
Figure 6:
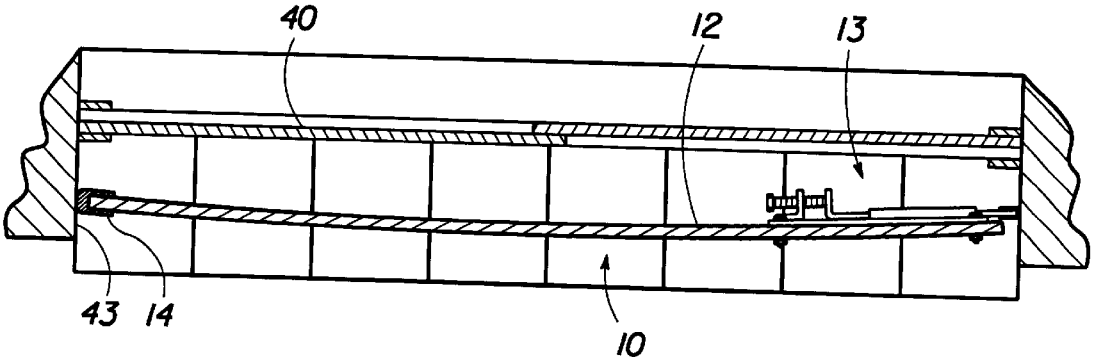
FIG. 6 is a horizontal section view of the window covering device which someone inside a dwelling has installed in the window frame on the exterior-facing side of the window.
Figure 7:
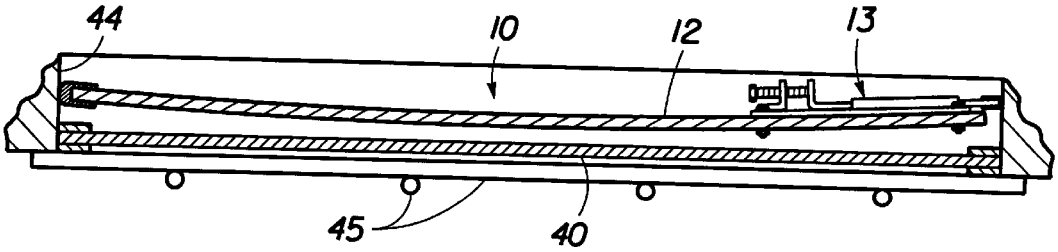
FIG. 7 is a horizontal section view of the window covering device which has been installed in the window frame on the interior-facing side of a window which has pre-existing burglar bars.

FIGS. 5, 6, and 7 show alternate choices for installation.

In FIG. 5, the window covering device 10 has been installed in the window frame 11 on the exterior-facing side of a window 40. Slide-arm-and-bolt assemblies 13 push against the right side 41 of the frame 11, while the rubber gasket 14 pushes against the left side 42 of the frame 11. The wood panel 12 has been bowed outward by forcing the slide arms 23 out.

To accomplish the installation shown in FIG. 6, the window must first be opened. Someone inside a dwelling can slip the window covering device 10 through the window 40 and rest the gasket 14 against the outer window frame 43 on the exterior side of the window 40. Once again, the window covering device 10 has been forced to bow in an outward direction.

As shown in FIG. 7, the window covering device 10 can also be installed on the inner window frame 44 on the interior side of a window 40 if, for instance, burglar bars 45 are present, the window 40 does not open, or the exterior side of the outer window frame 43 is inadequate to hold the window covering device 10 in place. While this installation choice does not protect the window glass, it affords protection from flying debris' entering the dwelling, and from theft or looting. As in the other types of installation, the window covering device 10 should be bowed outward for maximum resistance to wind.

Figure 8:
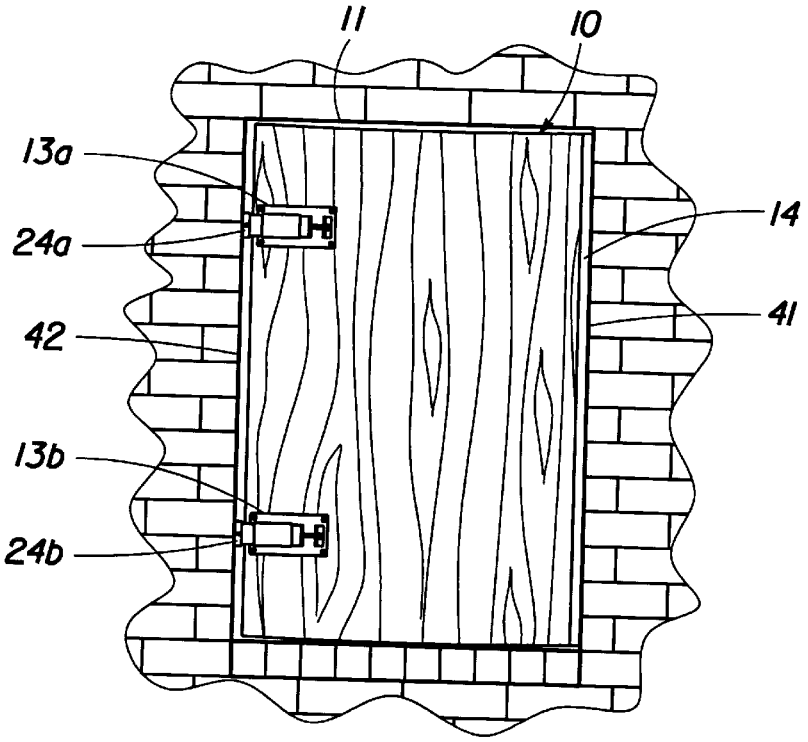
FIG. 8 is a plan view showing a preferred mounting configuration of the window covering device, with the slide-arm-and-bolt assemblies installed on the left side of the window.

As FIG. 8 shows, the window covering device 10 can be installed within the window frame 11 with the rubber gasket 14 pushed against the right side 41 of the frame and the rubber stoppers 24*a*, 24*b* of the slide-arm-and-bolt assemblies 13*a*, 13*b* pushed against the left side 42 of the frame.

Figure 9:
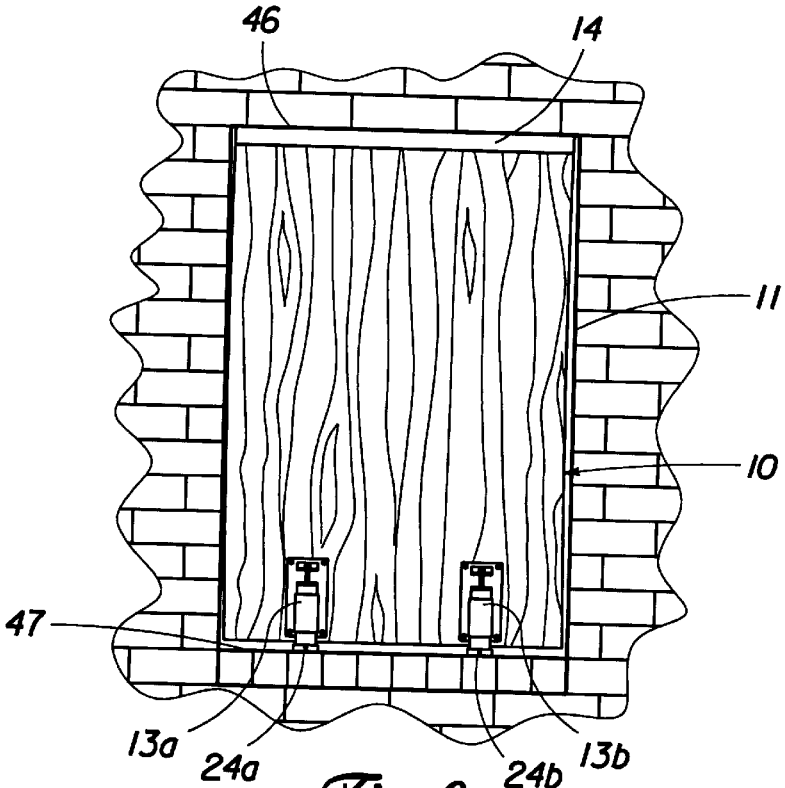
FIG. 9 is a plan view showing an alternate mounting configuration of the window covering device, with the slide-arm-and-bolt assemblies installed on the bottom of the window.

As FIG. 9 shows, the window covering device 10 can also be installed with the rubber gasket 14 pushed against the head 46 of the frame and the rubber stoppers 24*a*, 24*b* of slide-arm-and-bolt assemblies 13*a*, 13*b* pushed against the sill 47 of the frame.

Figure 10:
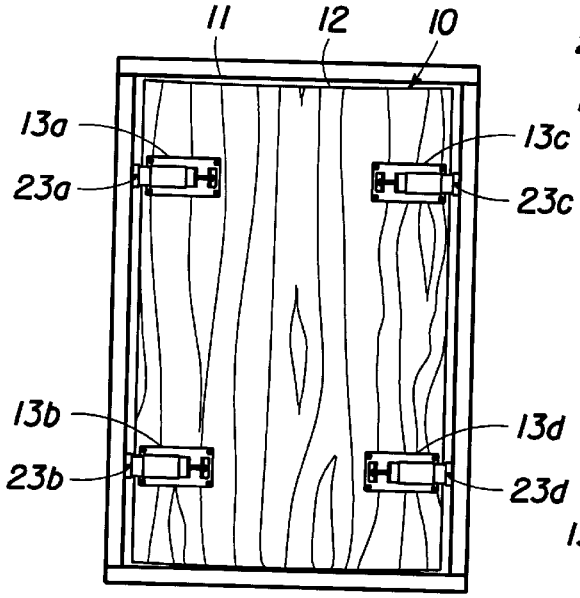
FIGS. 10, 11 and 12 are plan views showing alternate mounting configurations for a window covering device which is installed without a rubber gasket.
Figure 11:
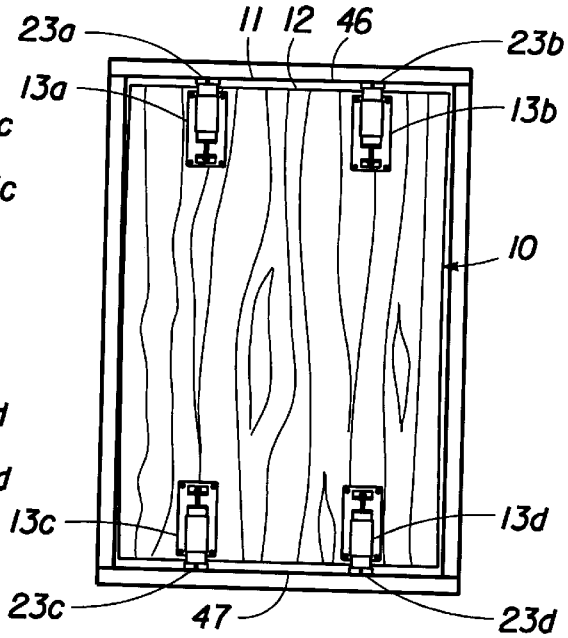
Figure 12:
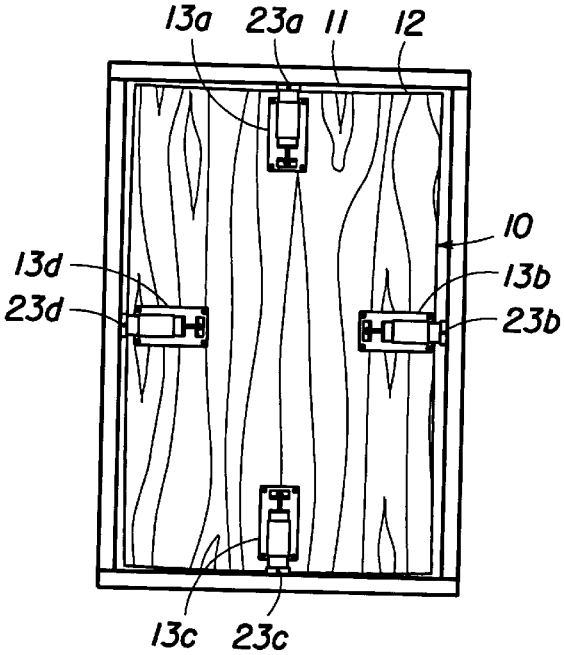

In FIGS. 10, 11, and 12, the window covering device is installed without using a gasket 14. Instead, two pairs of slide-arm-and-bolt assemblies 13 are used.

In FIG. 10, slide-arm-and-bolt assemblies 13*a*, 13*b* have been attached parallel to each other on the left side of wood panel 12, and slide-arm-and-bolt assemblies 13*c*, 13*d* have been fastened parallel to each other on the right side of wood panel 12. The window covering device 10 is arranged inside window frame 11, and the slide arms 23*a*, 23*b*, 23*c*, 23*d* are alternately advanced until the window covering device 10 is held firmly in place. Finally one pair of slide arms (23*a*, 23*b* or 23*c*, 23*d*) are advanced further until the wood covering device 10 bows slightly.

In FIG. 11, slide-arm-and-bolt assemblies 13*a*, 13*b* have been attached parallel to each other on the top portion of wood panel 12 and slide-arm-and-bolt assemblies 13*c*, 13*d* have been fastened parallel to each other on the bottom portion of the wood panel 12. The window covering device 10 is arranged inside window frame 11, with the rubber stoppers 24*a*, 24*b* of slide-arm-and-bolt assemblies 13*a*, 13*b* pushed against the head 46 of the frame, and the rubber stoppers 24*c*, 24*d* of slide-arm-and-bolt assemblies 13*c*, 13*d* pushed against the sill 47 of the frame. The slide arms 23*a*, 23*b*, 23*c*, 23*d* are alternately advanced until the window covering device 10 is held firmly in place. Finally one pair of slide arms (23*a*, 23*b*, or 23*c*, 23*d*) are advanced until the wood covering device 10 bows slightly.

In FIG. 12, slide arm-and-bolt assemblies 13*a*, 13*b*, 13*c*, 13*d* have been fastened to wood panel 12, one at the midpoint of each side. The window covering device 10 is arranged inside window frame 11, and slide arms 23*a* and 23*c* are advanced to hold it in place. Slide arms 23*b* and 23*d* are then tightened until the wood covering device 10 bows. Then slide arms 23*a* and 23*c* are loosened, then retightened to maintain the bowing.

Figure 13:
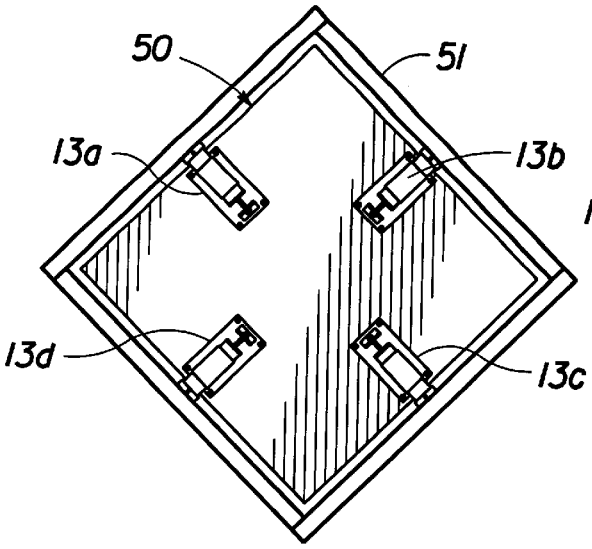
FIG. 13 is a plan view showing a window covering device constructed from metal for installation in a diamond-shaped window.
Figure 14:
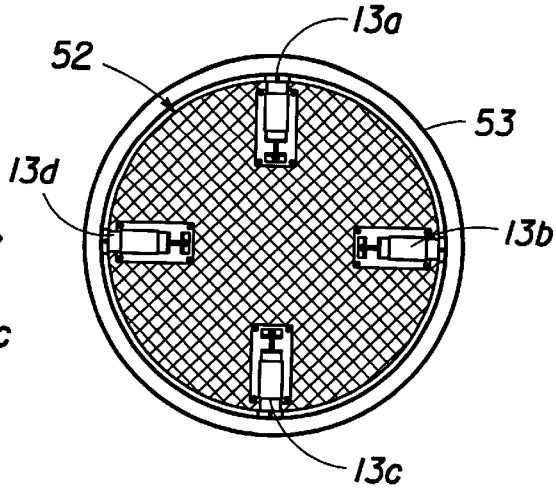
FIG. 14 is a plan view showing a window covering device constructed from expanded metal for installation in a round-shaped window.
Figure 15:
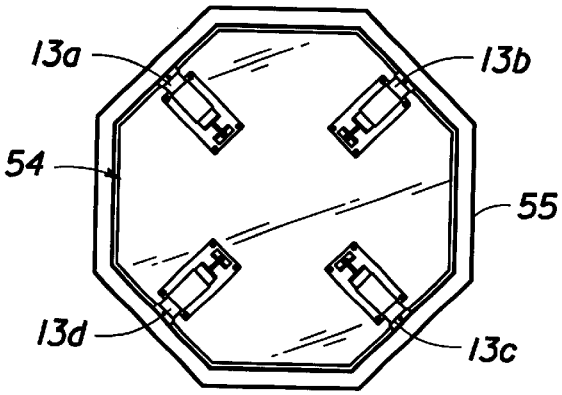
FIG. 15 is a plan view showing a window covering device constructed from plexiglass for installation in an octagonal-shaped window.

FIGS. 13, 14 and 15 show the wood covering device 10 constructed of different materials and used on odd-shaped windows. FIG. 13 shows a window covering device 50 constructed from a metal such as steel or aluminum for installation in a diamond-shaped window frame 51, using slide-arm-and-bolt assemblies 13*a*, 13*b*, 13*c*, 13*d*. FIG. 14 shows a window covering device 52 constructed of expanded metal (grating) for installation in a round-shaped window frame 53, using slide-arm-and-bolt assemblies 13*a*, 13*b*, 13*c*, 13*d*. FIG. 15 shows a window covering device 54 constructed of plexiglass (or urethane, or a similar material) for installation in an octagonal window frame 55, using slide-arm-and-bolt assemblies 13*a*, 13*b*, 13*c*, 13*d*.

Figure 16:
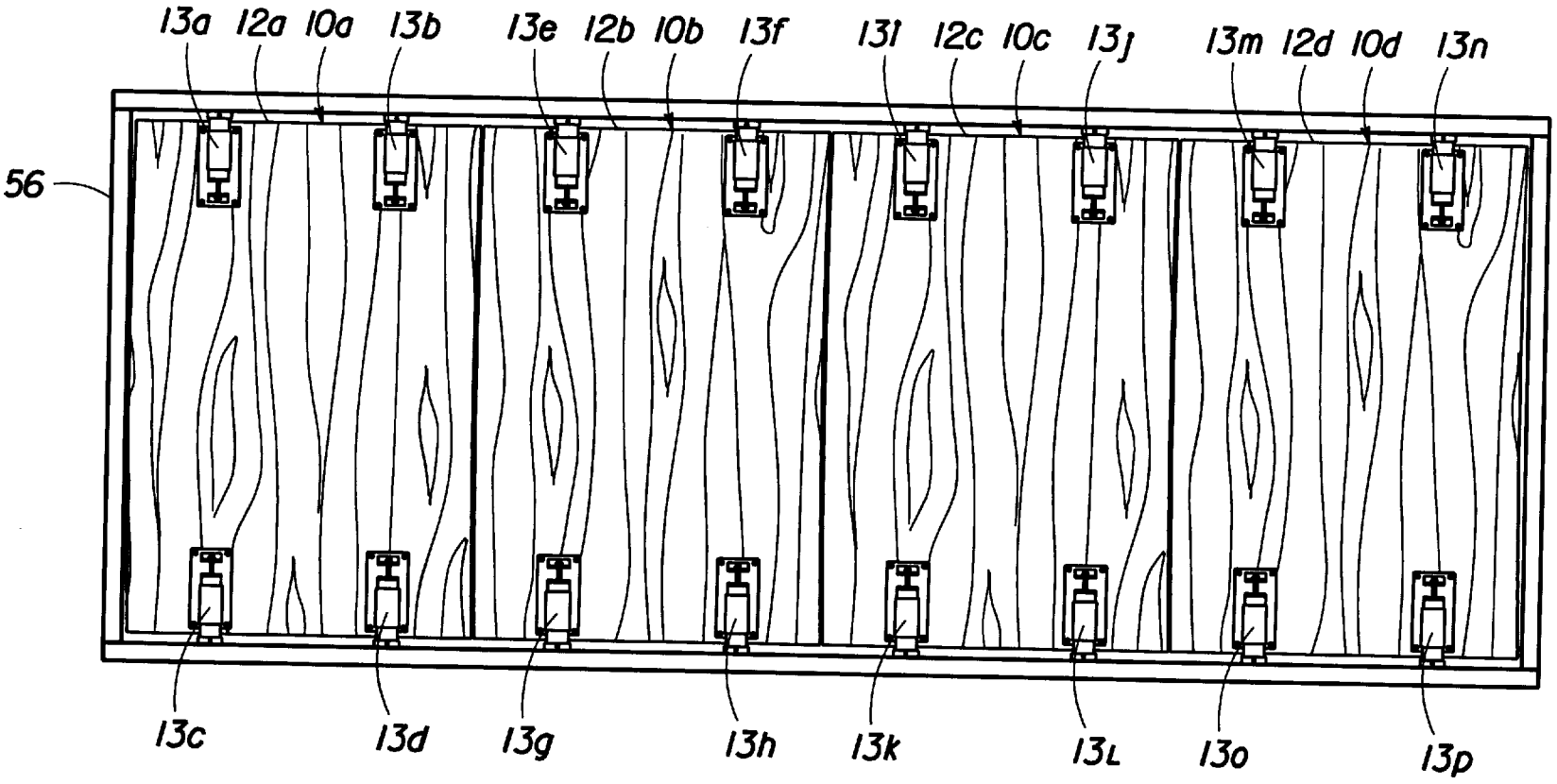
FIG. 16 is a plan view showing four window covering devices installed side by side in the frame of a large picture window.

Large picture windows or French doors present a large surface area to cover. To avoid the need to use a single, unwieldy piece of wood, several separate window covering devices can be installed adjacent to each other to completely cover the window. In FIG. 16, four window covering devices 10*a*, 10*b*, 10*c*, 10*d* have been arranged and installed adjacent to each other in a large window frame 56. Each has four slide-arm-and-bolt assemblies arranged in parallel pairs of two on opposite sides of the wood panels 12*a*, 12*b*, 12*c*, 12*d*, for a total of sixteen slide-arm-and-bolt assemblies 13*a*, 13*b*, 13*c*, 13*d*, 13*e*, 13*f*, 13*g*, 13*h*, 13*i*, 13*j*, 13*k*, 13*l*, 13*m*, 13*n*, 13*o*, 13*p*. Installation of each window covering device 10*a*, 10*b*, 10*c*, 10*d* is done individually, as described in FIG. 11 supra.

Figure 17:
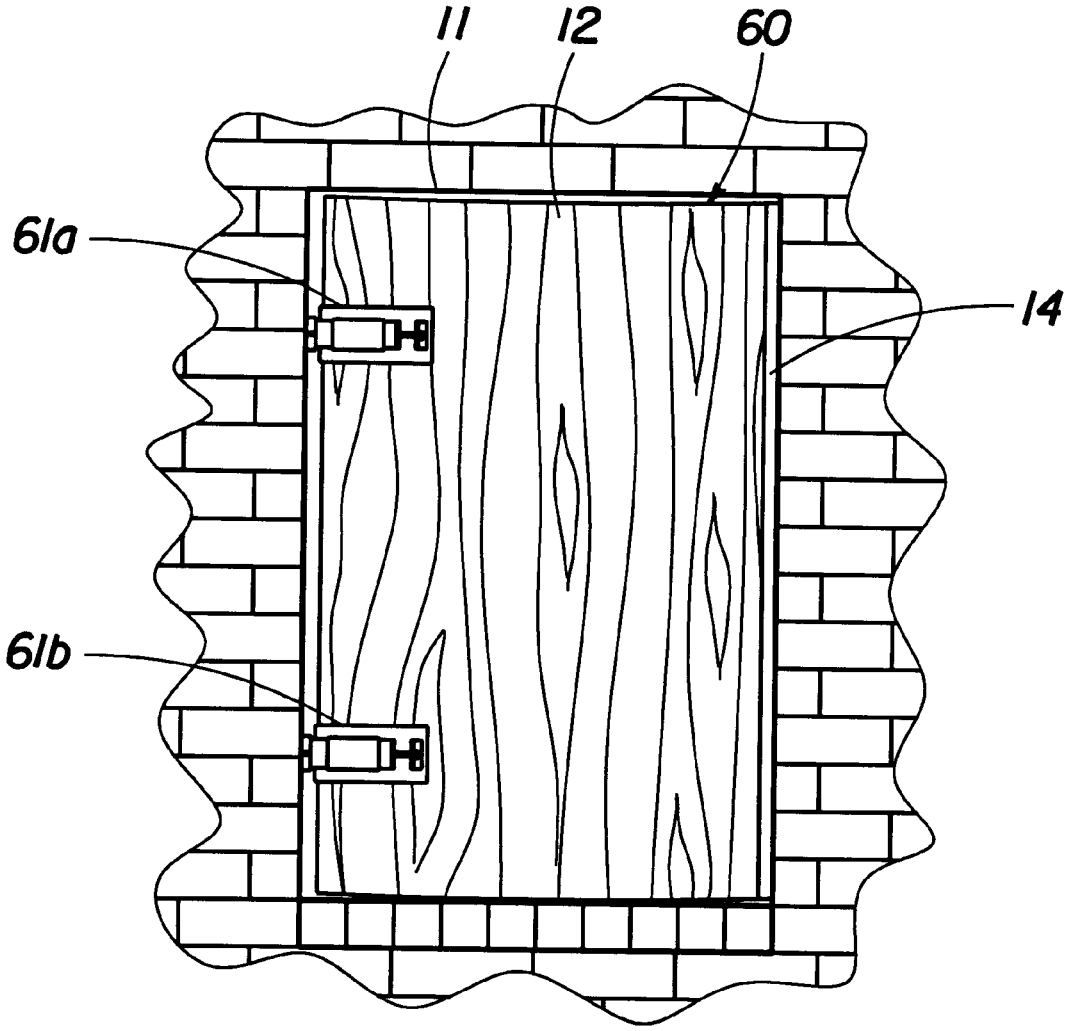
FIG. 17 is a plan view of an alternate embodiment of the window covering device installed in a window frame with clip-on slide-arm-and-bolt assemblies, according to the present invention.

FIG. 17 shows a wood covering device 60 which has been installed inside a window frame 11 using a pair of clip-on slide-arm-and-bolt assemblies 61*a*, 61*b* and a gasket 14 to hold the panel 12 firmly in place. (The clip-on slide-arm-and-bolt assembly 60 may also be used in place of the slide-arm-and-bolt assembly 13 as shown in FIGS. 10 through 16.)

Figure 18:
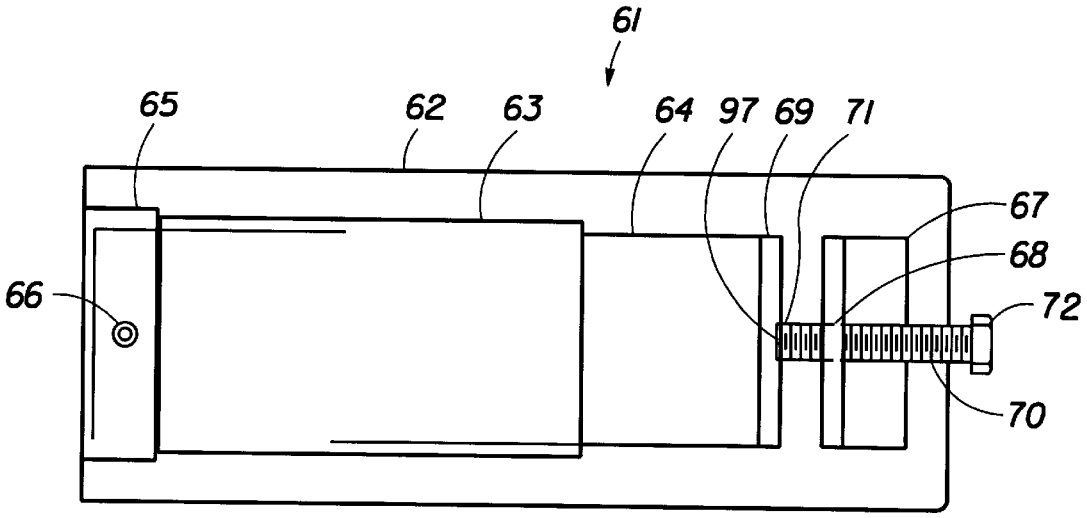
FIG. 18 is a top view of a single clip-on slide-arm-and-bolt assembly.

As shown in FIG. 18, the clip-on slide-arm-and-bolt assembly 61 comprises a metal base plate/bracket 62; a metal slide arm guide 63 welded to the base plate/bracket 62; an ell-shaped metal slide arm 64 inserted into the slide arm guide 63; a rubber stopper 65 attached to the end of the metal slide arm 64 with a rivet 66; an angle bolt bracket 67 with a threaded bolt hole 68 welded to the base plate/bracket 62 in a spaced-apart relationship to the upturned portion 69 of the slide arm 64; and a bolt 70 inserted through the threaded bolt hole 68 with its threaded end 71 resting in a recess 97 in the upturned portion 69 of the slide arm 64. The bolt 70 is advanced by turning the bolt head 72 with a wrench or pliers.

Figure 19:
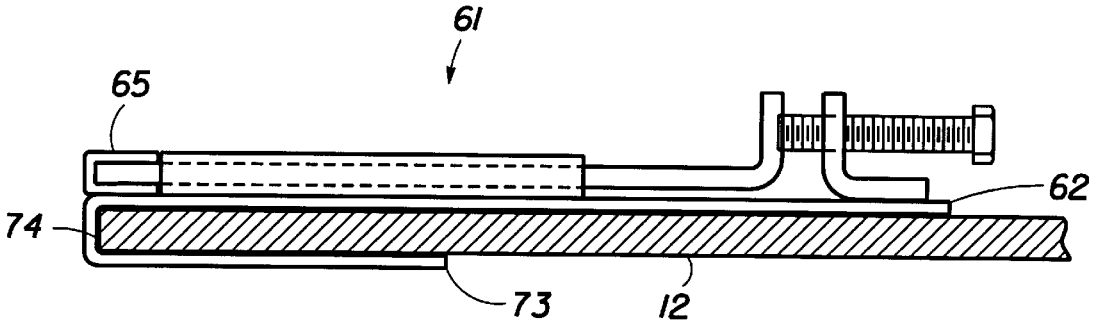
FIG. 19 is a side view of a single clip-on slide-arm-and-bolt assembly installed on a wood panel.

As shown in FIG. 19, the u-shaped bracket end 73 of the metal base plate/bracket 62 has been pulled over the edge 74 of wood panel 12; no fasteners are used. Typically, two clip-on slide-arm-and-bolt assemblies 61*a*, 61*b* are attached to one side of a wood panel 12 in a parallel relationship as shown in FIG. 17. Prior to installation, the end of the rubber stopper 65 is arranged to be even with the edge of the u-shaped bracket end 73.

Figure 20:
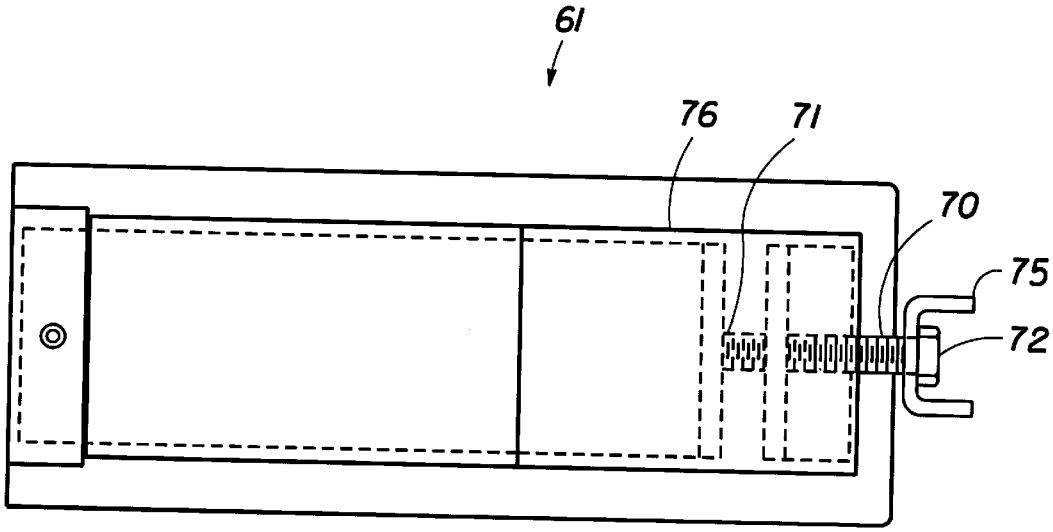
FIG. 20 is a top view of a single clip-on slide-arm-and-bolt assembly with a bolt-head security bracket and a screw-thread shield.
Figure 21:
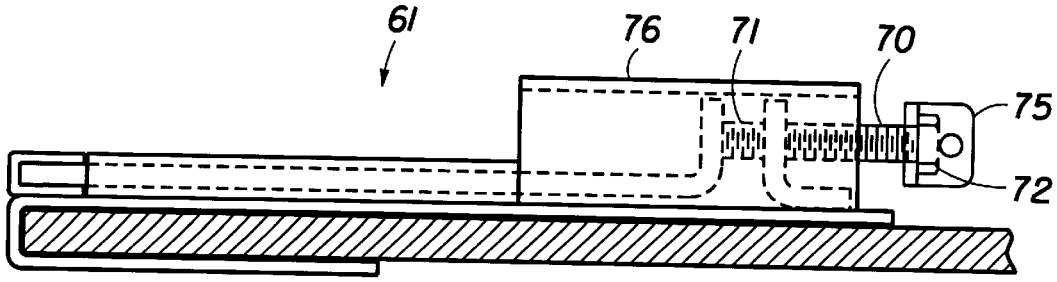
FIG. 21 is a side view of a single clip-on slide-arm-and-bolt assembly with a bolt-head security bracket and a screw-thread shield installed on a wood panel.
Figure 22:
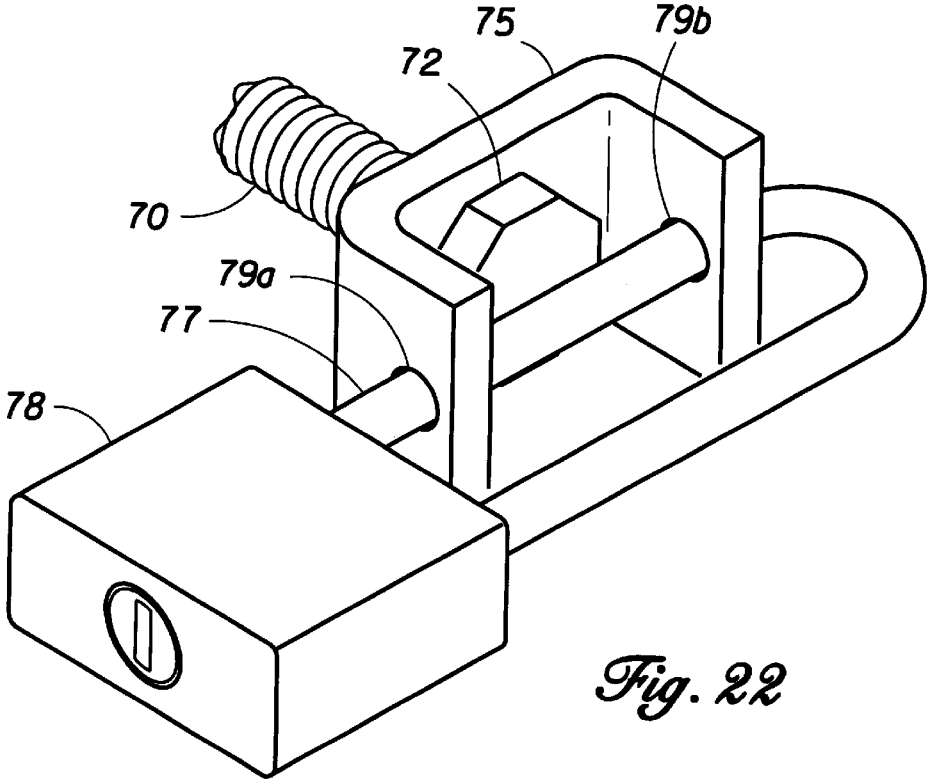
FIG. 22 is a perspective view of a tamperproof lock installed on the bolt-head security bracket.

In FIGS. 20 and 21, a tamper-proof embodiment of the clip-on slide-arm-and-bolt assembly 61 is shown. A bolt head security bracket 75, or shackle, has been threaded onto the bolt 70, and screw thread shield 76 has been installed to cover the threaded end 71 of the bolt 70. The bolt head security bracket 75 prevents a thief from using a wrench on the bolt head 72 to loosen the clip-on slide-arm-and-bolt assembly 61. In FIG. 22, the pivoting arm 77 of a lock 78 has been inserted through holes 79*a*, 79*b* of bolt head security bracket 75 to prevent the bolt head security bracket 75 from being moved back away from the bolt head 72.

The bolt head security bracket 75, the lock 78, and the screw thread shield 76 can also be installed on the slide-arm-and-bolt assemblies 13 disclosed in FIGS. 2 and 3.

Figure 23:
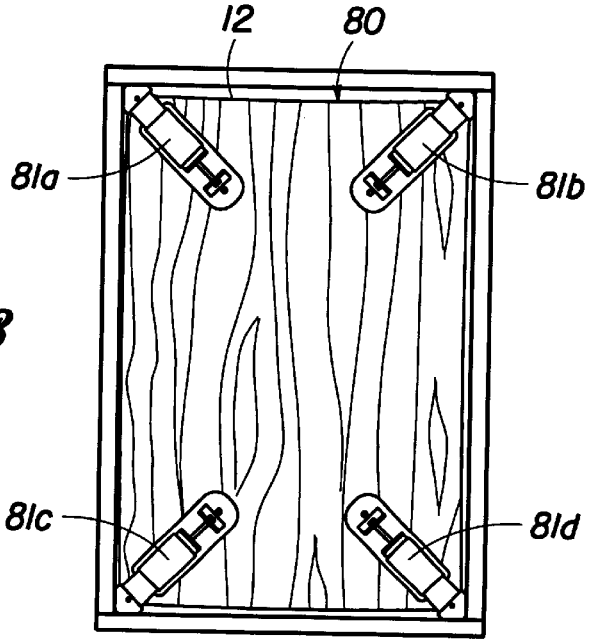
FIG. 23 is a plan view of another alternate embodiment of the window covering device installed in a window frame with corner-mounted bolt assemblies, according to the present invention.

In FIG. 23, a window covering device 80 utilizes four corner-mounted slide-arm-and-bolt assemblies 81*a*, 81*b*, 81*c*, 81*d*, to hold a panel 12 in place.

Figure 24:
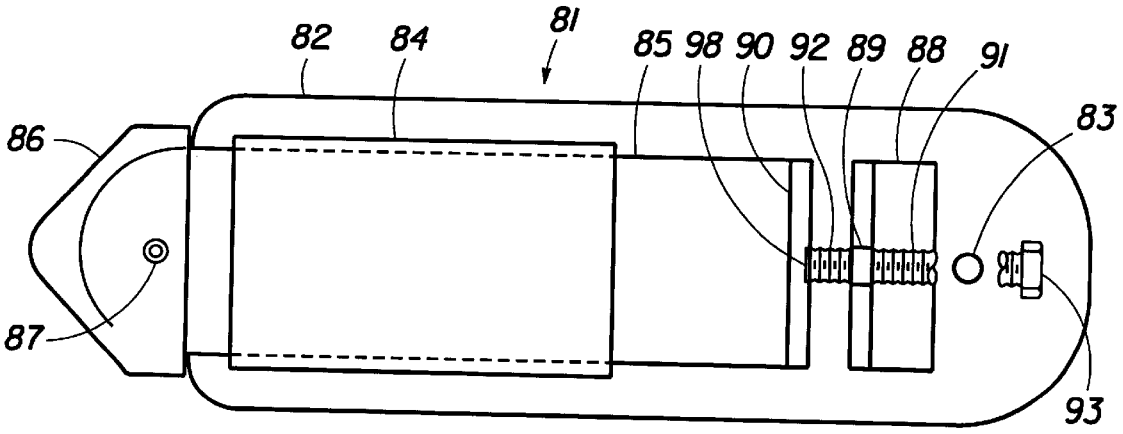
FIG. 24 is a top view of a single corner-mounted bolt assembly.

As shown in FIG. 24, the corner-mounted slide-arm-and-bolt assembly 81 comprises a metal base plate 82 with a fastener hole 83; a metal slide arm guide 84 welded to the base plate 82; an ell-shaped metal slide arm 85 inserted into the slide arm guide 84; a tapered, pivoting rubber stopper 86 attached to the end of the slide arm 85 with a rivet 87; an angle bolt bracket 88 with a threaded bolt hole 89 welded to the base plate 82 in a spaced-apart relationship to the upturned portion 90 of the slide arm 85; and a bolt 91 inserted through the threaded bolt hole 89 with its threaded end 92 resting in a recess 98 in the upturned portion 90 of the slide arm 85. The bolt 91 is advanced by turning the bolt head 93 with a wrench or pliers.

Figure 25:
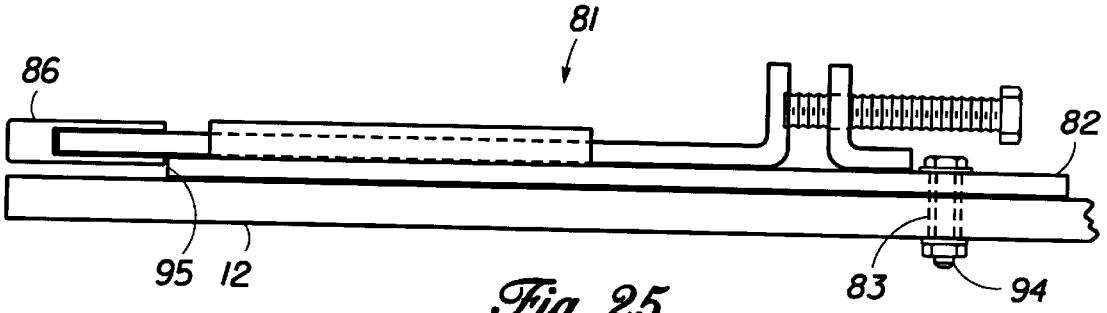
FIG. 25 is a side view of a single corner-mounted bolt assembly installed on a wood panel.

As shown in FIG. 25, the corner-mounted slide-arm-and-bolt assembly 81 has been fastened to a wood panel 12 with a single fastener 94, which has been inserted through fastener hole 83. The fastener 94 is typically a bolt, but can be a rivet or a pin. Prior to mounting, the base plate 82 has been arranged so that the pivoting rubber stopper 86 extends over the end 95 of the base plate 82. Each side of the rubber stopper 86 is open to accommodate pivoting. Typically, each of the slide-arm-and-bolt assemblies 81*a*, 81*b*, 81*c*, 81*d* is fastened to a corner of a panel 12, as shown in FIG. 23. (Prior to installation, the end of each rubber stopper 86 of each corner-mounted slide-arm-and-bolt assembly 81*a*, 81*b*, 81*c*, 81*d* has been arranged to be even with the corner of the panel 12.) The window covering device 80 is arranged inside window frame 11 (see FIG. 23) with each rubber stopper 86 pushed into one corner of the frame 11. Each slide arm 85 is alternately advanced until the window covering device 80 is held firmly in place. Finally, one slide arm 85 is advanced until the wood covering device 80 bows slightly.

Figure 26:
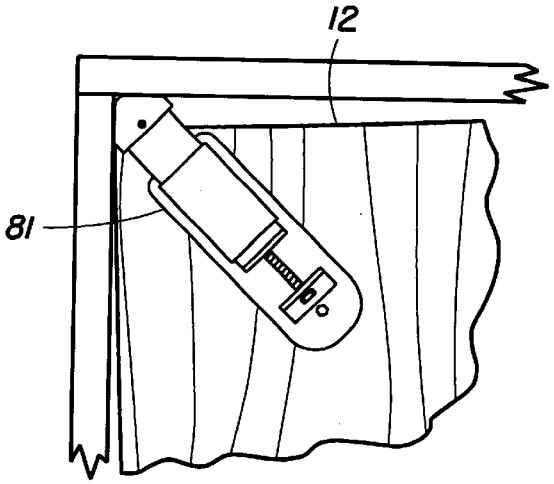
FIG. 26 is a plan view of the corner-mounted bolt assembly after pivoting.

As shown in FIG. 26, during severe weather, the corner-mounted slide-arm-and-bolt assembly 81 stays in place, even if the wood-panel 12 begins to rotate.

What is claimed is:

1. A device for installation within a frame of a window, said device comprising:

a rectangular panel sized to fit in said frame, the panel having a first side, a second side, a third side, and a fourth side, each of the sides having an edge;

a gasket affixed along the edge of the first side;

at least two holding mechanisms mounted at even intervals along the third side, each of said mechanisms having:

a base plate with a guide;

a slide arm with a first end and an ell-shaped second end, the slide arm disposed in the guide;

a stopper disposed on the first end of the slide arm;

an angle bolt bracket with a bolt hole, said bolt bracket attached to the base plate in a spaced-apart relationship to the ell-shaped second end of the slide arm; and a bolt with a threaded end and a bolt head, said bolt being inserted through the bolt hole, with the threaded end disposed against the ell-shaped end of the slide arm;

the slide arm being moved by turning the bolt head.

2. The device of claim 1 which further comprises:

a u-shaped shackle with a first upturned end, a central member, and a second upturned end, each end having a hole and the central member having a threaded hole, the threaded end of the bolt of the holding mechanism being inserted through the threaded hole of the shackle before being inserted through the bolt hole of the angle bolt bracket;

a shield for covering the threaded end of the bolt, the shield being attached to the base plate;

a removable lock with a pivoting arm, the arm being passed through the holes in the first upturned end and the second upturned end of the shackle and then secured by the lock.

3. The device of claim 1 wherein the panel has a small circular hole formed therein.

4. The device of claim 1 wherein the panel is made of material selected from the group comprising wood, metal, plexiglass and urethane.

5. A device for installation within a frame of a window, said device comprising:

a rectangular panel sized to fit in said frame, the panel having a first side, a second side, a third side, and a fourth side, each of the sides having an edge;

a gasket affixed along the edge of the first side;

at least two holding mechanisms arranged at even intervals along the third side, each of said mechanisms having:

a base plate with a unshaped end and a guide;

a slide arm with a first end and an ell-shaped second end, the slide arm disposed in the guide;

a stopper disposed on the first end of the slide arm;

an angle bolt bracket with a bolt hole, said bolt bracket attached to the base plate in a spaced-apart relationship to the ell-shaped second end of the slide arm; and a bolt with a threaded end and a bolt head, said bolt being inserted through the bolt hole, with the threaded end disposed against the ell-shaped end of the slide arm;

the slide arm being moved by turning the bolt head; and each of said mechanisms being arranged by pulling the u-shaped end of the base plate over the edge of the third side of the panel.

6. The device of claim 5 which further comprises:

a u-shaped shackle with a first upturned end, a central member, and a second upturned end, each end having a hole and the central member having a threaded hole, the threaded end of the bolt of the holding mechanism being inserted through the threaded hole of the shackle before being inserted through the bolt hole of the angle bolt bracket;

a shield for covering the threaded end of the bolt, the shield being attached to the base plate;

a removable lock with a pivoting arm, the arm being passed through the holes in the first upturned end and the second upturned end of the shackle and then secured by the lock.

7. The device of claim 5 wherein the panel has a small circular hole formed therein.

8. The device of claim 5 wherein the panel is made of material selected from the group comprising wood, metal, plexiglass and urethane.

9. A device for installation within a frame of a window, said device comprising:

a panel sized to fit in said frame, the panel having sides configured to complement the frame; and at least four holding mechanisms, each of which is mounted at the midpoint of each side, each of said mechanisms having:

a base plate with a guide;

a slide arm with a first end and an ell-shaped second end, the slide arm disposed in the guide;

a stopper disposed on the first end of the slide arm;

an angle bolt bracket with a bolt hole, said bolt bracket being attached to the base plate in a spaced-apart relationship to the ell-shaped second end of the slide arm; and a bolt with a threaded end and a bolt head, said bolt inserted through the bolt hole, with the threaded end disposed against the ell-shaped end of the slide arm;

the slide arm being moved by turning the bolt head.

10. The device of claim 9 which further comprises:

a u-shaped shackle with a first upturned end, a central member, and a second upturned end, each end having a hole and the central member having a threaded hole, the threaded end of the bolt of the holding mechanism being inserted through the threaded hole of the shackle before being inserted through the bolt hole of the angle bolt bracket;

a shield for covering the threaded end of the bolt, the shield being attached to the base plate;

a removable lock with a pivoting arm, the arm being passed through the holes in the first upturned end and the second upturned end of the shackle and then secured by the lock.

11. The device of claim 9 wherein the panel has a small circular hole formed therein.

12. The device of claim 9 wherein the panel is made of material selected from the group comprising wood, metal, plexiglass and urethane.

13. A device for installation within a frame of a window, said device comprising:

a panel sized to fit in said frame, the panel having sides configured to complement the frame; and at least four holding mechanisms, each of which is mounted at the midpoint of each side, each of said mechanisms having:

a base plate with a u-shaped end and a guide;

a slide arm with a first end and an ell-shaped second end, the slide arm disposed in the guide;

a stopper disposed on the first end of the slide arm;

an angle bolt bracket with a bolt hole, said bolt bracket attached to the base plate in a spaced-apart relationship to the ell-shaped second end of the slide arm; and a bolt with a threaded end and a bolt head, said bolt inserted through the bolt hole, with the threaded end disposed against the ell-shaped end of the slide arm;

the slide arm being moved by turning the bolt head; and each of said mechanisms being arranged by pulling the u-shaped end of the base plate over the edge of the third side of the panel.

14. The device of claim 13 which further comprises:

a u-shaped shackle with a first upturned end, a central member, and a second upturned end, each end having a hole and the central member having a threaded hole, the threaded end of the bolt of the holding mechanism being inserted through the threaded hole of the shackle before being inserted through the bolt hole of the angle bolt bracket;

a shield for covering the threaded end of the bolt, the shield being attached to the base plate;

a removable lock with a pivoting arm, the arm being passed through the holes in the first upturned end and the second upturned end of the shackle and then secured by the lock.

15. The device of claim 13 wherein the panel has a small circular hole formed therein.

16. The device of claim 13 wherein the panel is made of material selected from the group comprising wood, metal, plexiglass and urethane.

17. A device for installation within a frame of a window, said device comprising:

a rectangular panel sized to fit in said frame, the panel having four corners;

four holding mechanisms, each of said mechanisms having:

a base plate with a guide;

a slide arm with a first end and an ell-shaped second end, the slide arm disposed in the guide;

a pointed stopper disposed on the first end of the slide arm;

an angle bolt bracket with a bolt hole, said bolt bracket attached to the base plate in a spaced-apart relationship to the ell-shaped second end of the slide arm; and a bolt with a threaded end and a bolt head, said bolt inserted through the bolt hole, with the threaded end disposed against the ell-shaped end of the slide arm;

the slide arm being moved by turning the bolt head; and each of said mechanisms being pivotally mounted, using a single fastener, at one of the four corners of the panel.

18. The device of claim 16 wherein the panel has a small circular hole formed therein.

19. The device of claim 16 wherein the panel is made of material selected from the group comprising wood, metal, plexiglass and urethane.

20. A method of covering windows comprising:

cutting a panel to fit inside a window frame;

attaching at least two holding mechanisms, each having a slide arm with an end having a rubber stopper attached thereon;

arranging the panel in the window frame;

advancing the slide arm of each mechanism until the rubber stopper presses firmly against the window frame;

further advancing the slide arm of each mechanism until the panel bows in an outward-facing direction.

21. The method of claim 20 which further includes attaching a rubber gasket along an edge of the panel before arranging the panel in the window frame.

* * * * *